United States Patent [19]

Singer

[11] Patent Number: 5,067,242

[45] Date of Patent: Nov. 26, 1991

[54] MULTIPLE DESIGN PUNCH AND EMBOSSER

[76] Inventor: Mark G. Singer, 32 E. Princeton Rd., Bala Cynwyd, Pa. 19004

[21] Appl. No.: 644,642

[22] Filed: Jan. 23, 1991

[51] Int. Cl.[5] ..... B26F 1/00

[52] U.S. Cl. ..... 30/364; 69/2

[58] Field of Search ..... 30/363, 364, 366, 359, 30/358; 69/2; 101/3.1, 18, 19

[56] References Cited

U.S. PATENT DOCUMENTS

| | | | |
|---|---|---|---|
| 507,674 | 10/1893 | Connell et al. | 30/364 |
| 521,358 | 6/1894 | Bauus | 30/364 |
| 1,375,721 | 4/1921 | Nichols | 137/271 |

*Primary Examiner*—Douglas D. Watts

*Attorney, Agent, or Firm*—Caesar, Rivise, Bernstein, Cohen & Pokotilow, Ltd.

[57] ABSTRACT

A punch and embossing device for punching out or impressing a plurality of designs in a sheet. The device includes a base, a multiple punch cassette and a handle. The handle is pivotally connected to the base. The base has a punch station disposed adjacent the handle. The base station comprises a platform parallel to the plane in which the axis of pivot of the handle is disposed to support the cassette. The handle contains a member which contacts the cassette when the free end of the handle is pivoted toward the base. The cassette comprises a first plate containing a plurality of punches and a second plate each containing a plurality of dyes each of which is aligned with one of the punches and has a complementary shape to the punch shape. The first plate normally being spaced from and spring urged away from the second plate so that a sheet may be placed between the plates. The handle member is urged against the first plate when the free end of the handle is pivoted towards the base to cause the first plate to be urged against the second plate. The member contacts the top plate adjacent the center of the plate so that the first plate remains aligned with and substantially parallel to the second plate throughout movement of the first plate with respect to the second plate.

16 Claims, 4 Drawing Sheets

FIG. 1
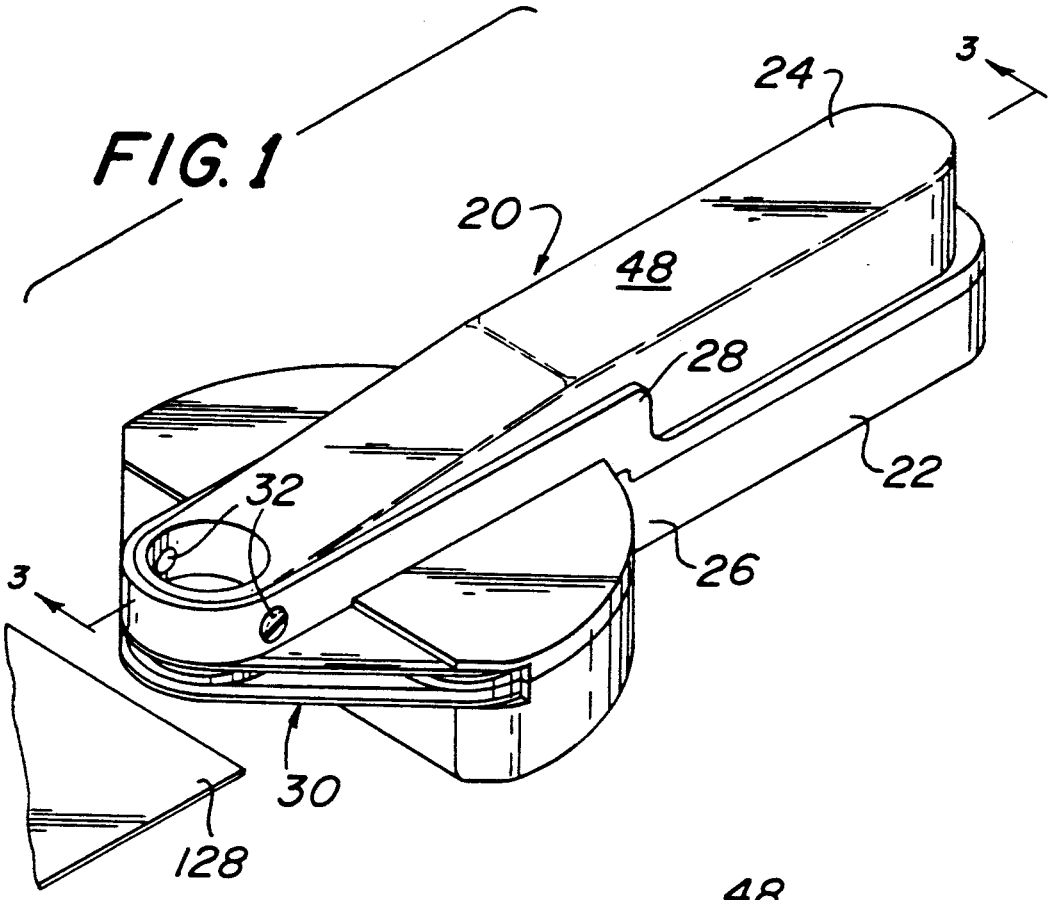
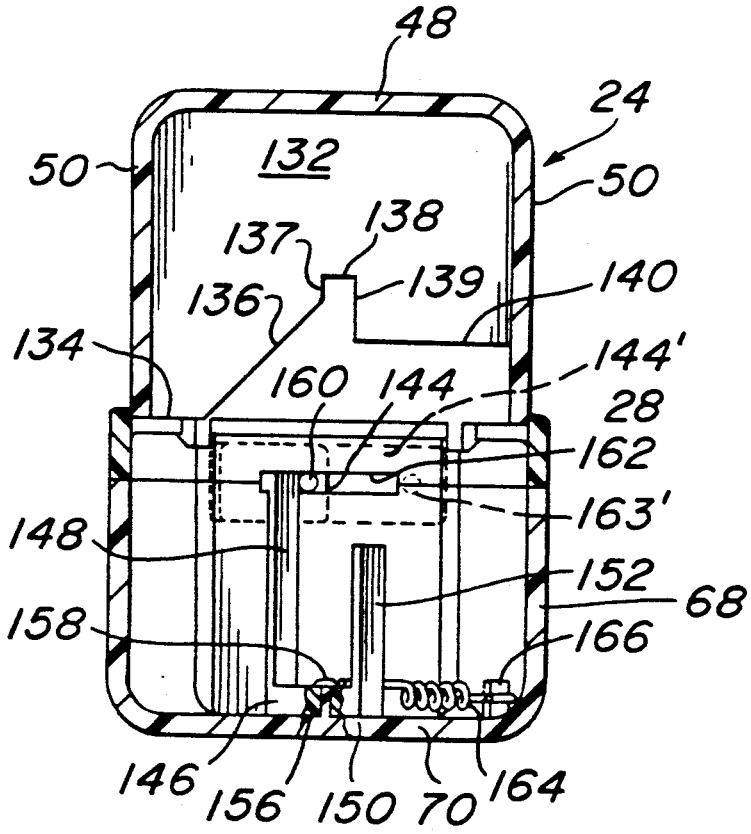
FIG. 5

144
150
132
140
152
64'
24
56
120
124
110
54
122
86
52
30
100
112
90
118
116
106
108
104
94
118
80
82
84

144
148
22
24
137
152
142
48
150
24
56
110
120
124
122
108
106
116
86
30

MULTIPLE DESIGN PUNCH AND EMBOSSER

This invention relates generally to hole punchers and embossers and more particularly to a device which may be used to punch holes of a plurality of shapes or make a plurality of different impressions.

BACKGROUND OF THE INVENTION

There are many existing hole punchers that enable the punching of a shape. These hole punchers are, however, normally limited to the predetermined shape that is built into the puncher or the shapes of punches which must be replaced on an individual basis.

There has been a long existing need for an inexpensive punch for a plurality of shapes which is easy to operate and which facilitates changing the shapes of holes that may be punched in related groups.

The patent to E. B. Nichols, U.S. Pat. No. 1,375,721 patented on Apr. 26, 1921 shows a toy punch having a set of dyes mounted about the base of the toy. According to the inventor, any number of sets of dyes may be provided, however, the Nichols toy must be disassembled in order to enable a new set of dyes to be replaced.

OBJECTS OF THE INVENTION

It is therefore an object of this invention to overcome the disadvantages of the prior art.

It is another object of this invention to provide a new and improved punch and embosser which punches a plurality of different shaped openings and is also used for impressing different embossing designs.

It is still another object of this invention to provide a new and improved punch and embosser which facilitates changing the designs and shapes that it may punch or emboss.

Still another object of this invention is to provide a new and improved punch and dye cassette containing a plurality of different shaped punches which is easy to remove and insert into a punching device.

SUMMARY OF THE INVENTION

These and other objects of the invention are achieved by providing a punch and embosser for punching out and embossing a plurality of designs in a sheet. The punch includes a base, a multiple punch cassette and a handle. The handle is pivotally connected to the base. The base has a punch station disposed adjacent to the handle. The base station comprises a platform to support the cassette. The platform is provided in a plane parallel to the plane in which the axis of pivot of the handle is disposed. The handle contains a member which contacts the cassette when the free end of the handle is pivoted toward the base. The cassette comprises a first plate containing a plurality of punches and a second plate containing a plurality of dyes each of which is aligned with one of the punches and is complementary to the design of the respective punch. The first plate normally is spaced from and spring urged away from the second plate so that a sheet may be placed between the plates. The handle member is urged against the first plate when the free end of the handle is pivoted towards the base to cause the first plate to be urged against the second plate. The member contacts the top plate adjacent the center of the plate so that the first plate remains aligned with and substantially parallel to the second plate throughout movement of the first plate with respect to the second plate.

DESCRIPTION OF THE DRAWINGS

Other objects and many of the attendant advantages of this invention will be readily appreciated as the same becomes better understood by reference to the following detailed description when considered in connection with the accompanying drawings wherein:

FIG. 1 is an isometric view of a punch and embossing device embodying the invention;

FIG. 5 is an enlarged sectional view taken along the line 5—5 in FIG. 3;

DETAILED DESCRIPTION OF THE PREFERRED EMBODIMENT

Figure 2:
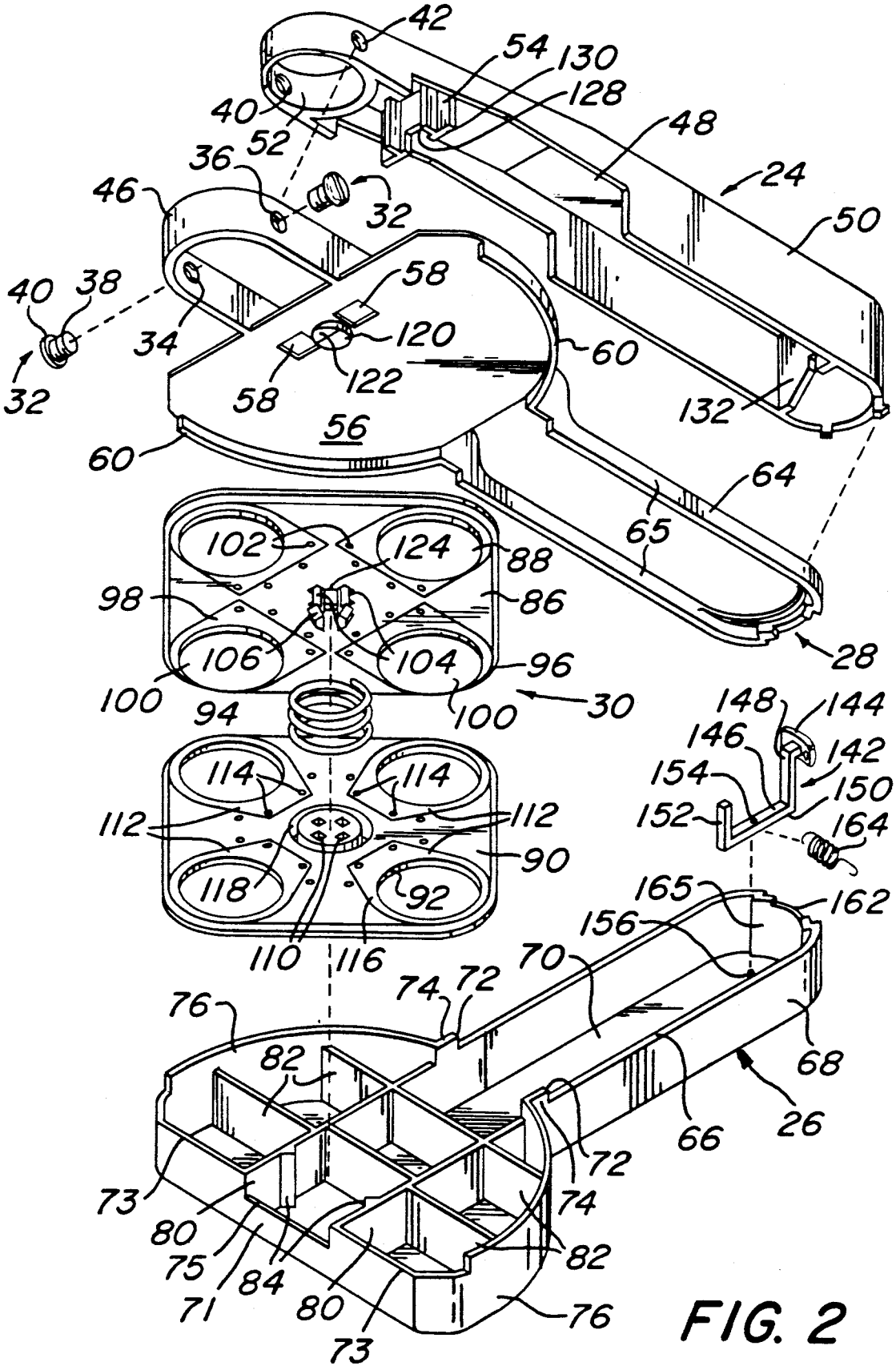
FIG. 2 is an exploded isometric view of the punch and embossing device shown in FIG. 1.

Referring now in detail to the various figures of the drawing wherein like reference characters refer to like parts, there is shown at 20 in FIG. 1 a punch and embossing device embodying the invention.

The punch and embossing device 20 as shown in FIG. 1 and FIG. 2 basically comprises a case 22 and a handle 24. The case comprises a base member 26 and cover member 28. The cover member 28 is adhesively secured to the base member to form a case for the receipt of a cassette or cartridge 30.

As will hereinafter be seen in greater detail, the cassette 30 contains a plurality of punches and dyes which may be used for either punching holes or impressing designs into a sheet such as paper or thin plastic, etc. The cassette fits into the case 22 in a slotted opening formed in the front of the device 20. When the cassette 30 is slid into the case 20, it is releasably secured in the case 22 and rotatably mounted. The cassette is rotated about a vertically disposed axis which enables any one of the plurality of punches in the cassette 30 to be placed below an opening at the front end of the device for the purpose of punching an opening or embossing a design in a sheet.

The components of the punch and embossing device are best seen in FIG. 2. As best seen in FIG. 2, the handle 24 is pivotally connected to the cover member 28 by suitable fasteners 32 which are disposed in openings 34 and 36 of the cover member 28. The fasteners 32 each have a threaded end 38 and a head 40 at its other end which has a slotted opening to receive a screw driver or other fastening member for the purpose of securing fasteners 32 in the openings 34 and 36. The fasteners extend through openings 34 and 36 by sliding therethrough and are then threadedly secured with the threaded portions 38 thereof in openings 40 and 42.

Prior to insertion of fasteners 32, the end of handle 24 containing openings 40 and 42 is inserted in the U-shaped end 46 of the cover member 28 so that openings 34 and 36 are aligned with openings 40 and 42. The fasteners 32 are then threadedly secured in openings 40 and 42. Handle 24 is thus pivotable or journalled about the axis of fasteners 32.

The handle 24 is an elongated member which is preferably molded and is therefore substantially hollow. The handle thus contains a top wall 48 and a skirt 50 which is integral with and transverse to and depends from the top wall 48.

At the front end of the handle 24 is an opening 52 which is provided in the forwardmost portion of the handle. The opening 52 is directly aligned with the punch that is usable.

Directly behind the opening 52 and depending from the top wall 48 of the handle is an actuating member 54 which depends from the top wall 48 and is used for actuating the punch by coaction with the cassette 30 as will hereinafter be described in greater detail.

The cover member 28 comprises in addition to the front U-shaped member 46 a central cover portion 56 which is planar and generally semi-circular and contains openings 58 through which the ends of actuating member 54 extend for the purpose of actuating the cassette 30.

The cover member 28 also includes a pair of spaced arcuate depending skirts 60 on each side of the cover portion which are peripheral with the cover member 56 and extend transverse to the plane of the surface of portion 56.

The U-shaped front end 46 of the cover portion includes a pair of legs 62 which are planar and extend upwardly transverse to the top surface of the planar portion 56 of the cover member 26. Legs 62 are also integral with the portion 56 and extend into and form the legs of the rear U-shaped portion 64 of the cover member 28. The skirts 60 of the cover portion 56 are integral with the legs 65 of the rear portion 64 of the cover member 28.

The bottom surface of the legs 65 of the rear portion 64 of cover portion 28 are aligned with and adhesively secured to the top surface 66 of the U-shaped skirt 68 of the base portion 26. That is, base portion 26 includes a skirt 68 which is peripheral and is perpendicular to the bottom wall 70 thereof and extends upwardly therefrom.

The rear portion of the skirt 68 is slightly shorter than the wall portion beginning at point 72 on each side of the base 26. The skirt 68 is thus planar at portion 74 on each side of the skirt 68 and then the skirt flares out at portions 76 on each side which portions 76 are arcuate and extend about a semi-circular portion 78 of the bottom wall 70. The semi-circular portion 78 of the base 26 is planar and includes transversely extending vertically disposed ribs 80 and 82 which extend upwardly and transversely to the bottom wall 70. The ribs 80 and 82 have a top surface which is planar and which forms a platform for supporting the cassette 40.

On the inner surface of the central ribs 80 are provided a pair of opposed elongated indexing beads 84 which have a substantially triangular cross section and which, as will hereinafter be seen, are the beads which index the cassette as it rotates about a vertical axis so that the punch is disposed in the appropriate position for punching an opening in a sheet.

The cassette 30 comprises a top plate 86 which contains a plurality of punches 88, a bottom plate 90 containing a plurality of dyes 92 and a spring 94.

The top plate 86 is generally rectangular and planar and contains rounded corners 96. Although the punch shapes 88 are shown as circular in FIG. 2 it should be understood that a plurality of different shapes are used for each cassette. The punches may also be impression punches for embossing a design. The top surface of the plate contains a decal above each punch so that the user may see the design which is in position below opening 52.

Thus, in the preferred embodiment, each cassette has a group of different shapes in accordance with a particular subject or theme. Accordingly, a transportation cassette contains four punches which have the outline shape of four different modes of transportation, such as a plane, a car, a boat and/or train. Similarly, another cassette has zoo animals containing for example a lion, a bear, a monkey and an elephant. Similarly, another cassette contains pets which has pictures of a cat, a dog, a canary and/or a fish. The punches 88 have these outlines in the preferred embodiment.

Figure 3:
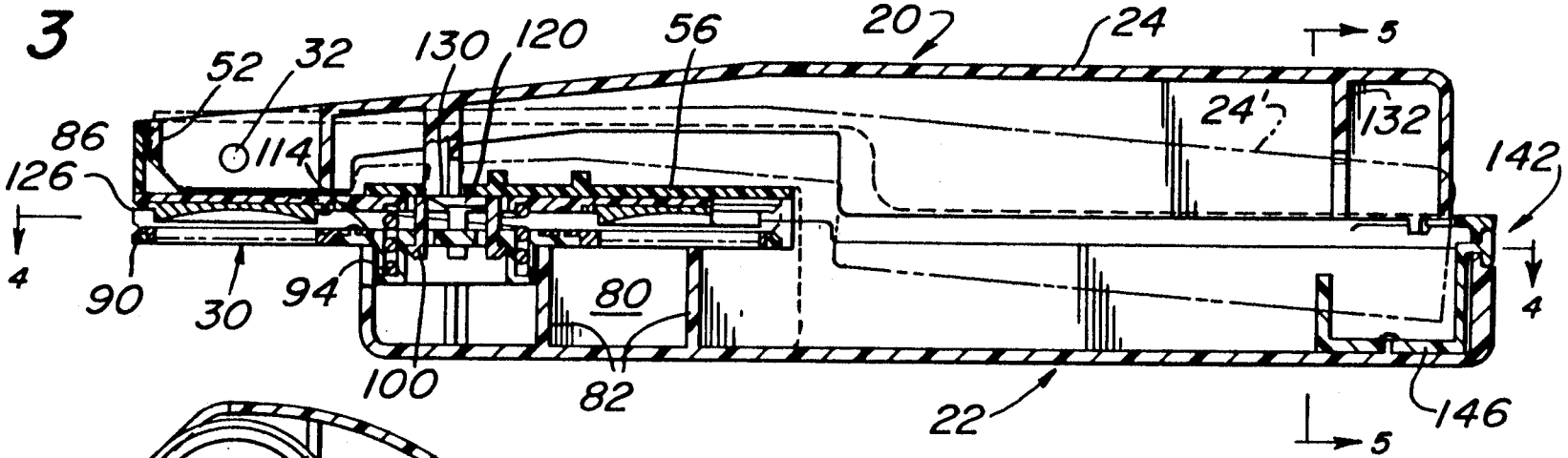
FIG. 3 is an enlarged sectional view taken along the line 3—3 in FIG. 1.

Each of the punches are comprised of a base plate portion 98 and a cutting projection 100 as best seen in FIG. 3. Each of the base plate portions 98 of the punches have a pair of openings and are connected by a pair of pins 102 which are integral with and extend from the plate 86 and through the openings. The pins are swaged at their end to permanently secure the punches to the top plate 86. The top plate has a plurality of recesses in the inner surface in which the plates fit so that the punches remain stationery in the top plate 86.

Figure 6:
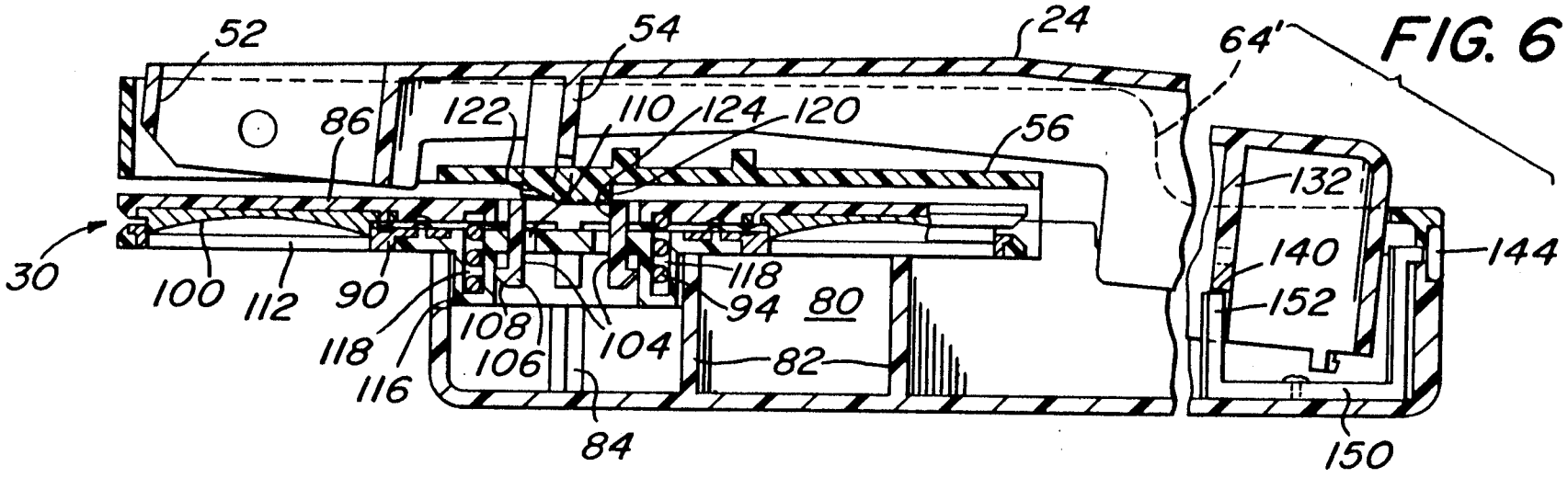
FIG. 6 is an enlarged sectional view similar to FIG. 4, with portions removed for purpose of clarity, to illustrate the operation of the punch and embosser.
Figure 7:
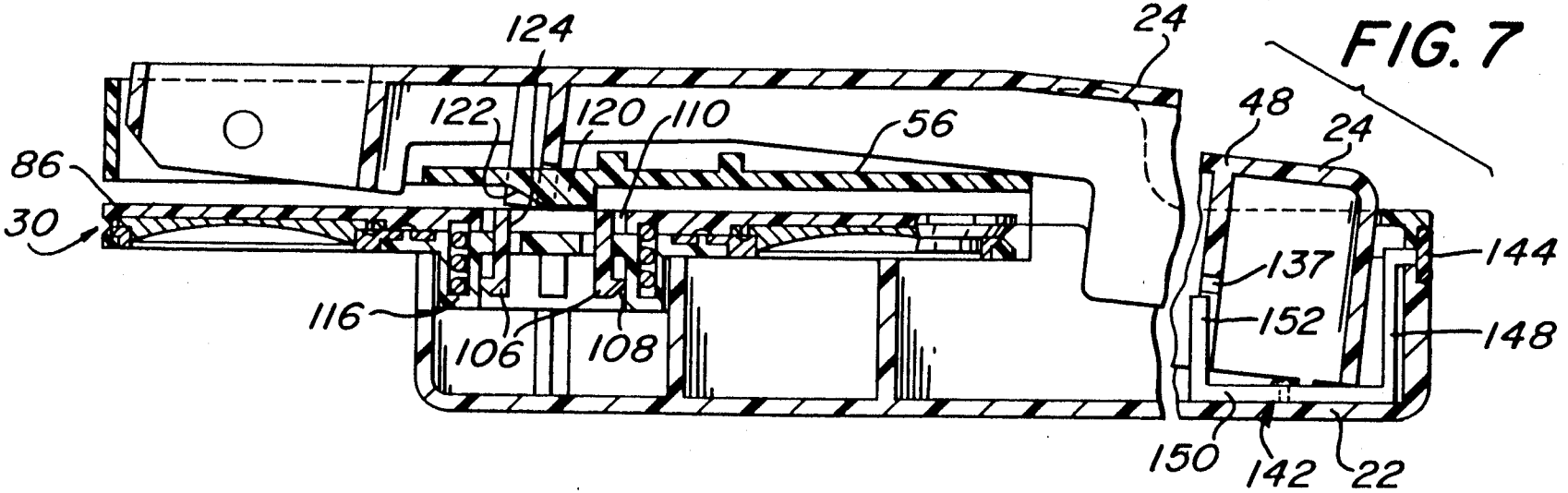
FIG. 7 is an enlarged sectional view similar to FIG. 6 to illustrate the operation of the device which permits removal of a cassette.

In addition, the top plate 86 also includes a plurality of projections 104 which are integral with the plate 86 and have an enlarged end portion 106. As best seen in FIGS. 6 and 7 the end 106 of each projection 104 has a cam surface 108 so that it may be urged through an opening 110 in the bottom plate 90 for attachment thereto yet prevent removal of the projection 104 after its snaps into place in position in the opening 110 in the bottom plate 90. It can be seen that four of these projections 104 are provided which are spaced 90 degrees from each other and equally spaced about and from the center of the base plate.

The bottom plate 90 includes four openings in which the dyes 92 are disposed. The dyes are also of different shapes and although shown as circles in the drawings of this case, it should be understood that they are in the shape of the outer surface of the punches 88. When the dyes are for embossing, the dyes each comprise a plate which is complementary to the design of the embossing punch. Thus, when the punches 88 are hole punches each one of the openings 92 corresponds to the shape of the outer surface of punches 88.

The four dyes 92 include a base plate 112 which is secured to the bottom plate 90 by suitable fasteners comprising integral pins 114 projecting from the top surface of plate 90 which are swaged at the top surface to maintain the plates in place. The top surface of plate 90 also includes four recesses which are the same shape as plates 112 so that the dyes are further prevented from moving laterally with respect to the plate.

Plate 90 also includes a cylindrical boss 116 which projects from the bottom surface of plate 90 as best seen in FIG. 6. The cylindrical boss 116 contains an annular recess 118 which extends into the boss 116 and extends up through the top surface of plate 90 and receives the helical spring 94.

As best seen in FIG. 3, the top plate 86 is thus disposed directly aligned with and parallel to plate 90 in spaced relationships by virtue of spring 94 which spaces the two plates when the cassette is assembled. In assembling the plate 86 upon plate 90, the projections 104 extend into openings 110 with the cam surface 108 on the enlarged portion 106 of projection 104 forcing the projection inwardly until the enlarged portion 106 of projection 104 clears the opening and then the projections snap out radially and prevent removing the plates away from each other. The projections also facilitate the maintaining of a parallel relationship between the top and bottom plate. As also seen in FIG. 3, the top surface of the ribs 80 and 82 provide a platform for the cassette which is parallel to the axis of the fasteners 32 which is the axis of rotation for the handle 24.

As best seen in FIG. 3, the cassette 30 is disposed between the cover portion 56 and the top surface of the ribs 80 and 82 which form a platform for the cassette within the punch and embossing device 20. A horizontally disposed slot is thus formed between the cover portion 56 and the platform formed by the ribs 80 and 82 for receipt of the cassette 30.

As best seen in FIGS. 2 and 3, the cover portion 56 includes a centering post 120 which is disposed between openings 58 and is integral with cover portion 56 and projects downwardly therefrom. The projection 120 includes a cam surface 122 which extends towards the front of the cover member 56.

As best seen in FIG. 2, FIG. 6 and FIG. 7 a circular opening 124 is provided in plate 86 through the center thereof between the projections 104. When cassette 30 is disposed within the slot formed by the bottom surface of cover portion 56 and the top surface of the ribs 80 and 82, the cassette is slid into the slot going from left to right as shown in FIG. 3. As best seen in FIG. 2, the front wall 71 of skirt 68 extends parallel to ribs 82 and the top edge 73 is at the same level and is in the same plane as the top edge of ribs 80 and 82. The top edge 73 of wall 71 is however interrupted by a rectangular notch or recess which forms a lower front edge 75 which permits the passage of the cylindrical boss 116 over the edge 75 when cassette 30 is slid into the slot formed by the bottom surface of cover portion 56 and the platform formed by the top edges of ribs 80, 82 and front wall 71.

When the leading or innermost edge of the cassette abuts the cam surface of centering post 120, the cassette 30 compresses as seen in FIG. 6. When the cassette is placed in the proper position with the opening 124 aligned with post 120, the post snaps into place as shown in FIG. 3. The cassette may then be rotated about the post 120 to any one of four operative positions. The operative positions are indexed by virtue of a longitudinally extending recess at four positions on the outer surface of the cylindrical boss 116. The four recesses are provided on the outer surface of the boss 116 spaced 90 degrees about the surface and directly in line with the center of the plate 90 and the center of each of the four openings provided in plate 90 for receipt of the dyes 92.

Figure 4:
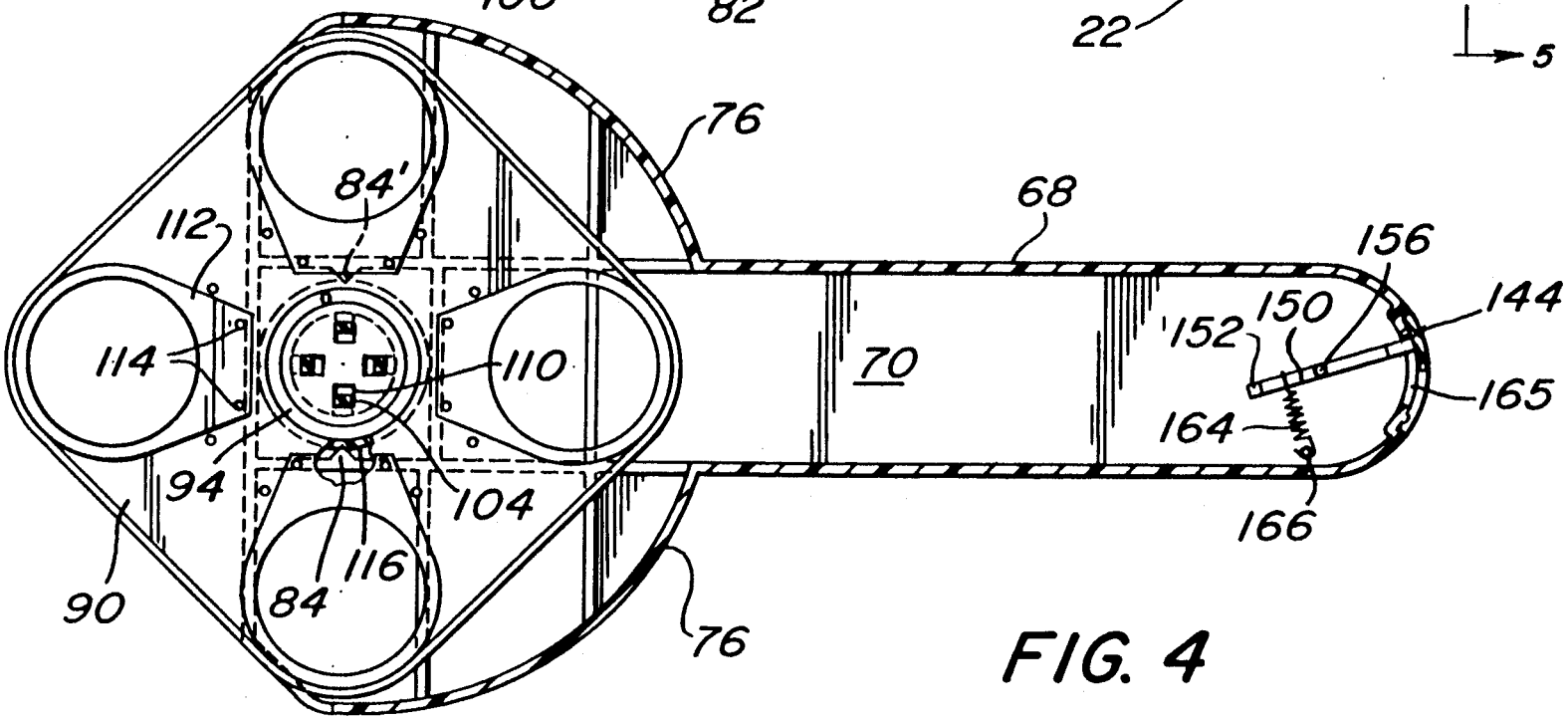
FIG. 4 is a sectional view taken along the line 4—4 in FIG. 3 with portions removed for purpose of clarity.

As thus seen in FIG. 4, the beads 84 engage diametrically opposed recesses in the outer surface of the boss 116 to provide a snap fit of the cassette at each of the four positions with a different one of the punches and dyes of the cassette 30 in the forwardmost position disposed below opening 52 in the handle 50.

In FIG. 3, the handle 24 is shown in a neutral position with respect to the case 22. In this position, there is a space 126 or slot 126 provided in which a sheet 128 may be placed for the purpose of having an opening punched therein. In order to punch the opening, the handle 24 is rotated about its pivotable end 32 with the free end at the rear of the punch device 20 being moved to the position shown in phantom at 24' in FIG. 3.

Referring to FIG. 2, it can be seen that the actuating member 54 which depends from the top wall 48 of the handle 24 has a rectangular recess 128 to provide at the outermost edge of the projection 54 a pair of actuating ends 130 which extend through openings 58 in the cover portion 56 of the case 22. When the handle 24 is moved to the position shown in phantom in FIG. 3, the actuating ends 130 abut the top surface of the plate 86 of cassette 30 adjacent the center of the top surface to cause the top plate 86 to be moved toward the bottom plate 90 of the cassette 30 and thereby cause the punches 100 to enter the openings in dyes 112. Throughout the cutting action, the plates 86 and 90 remain parallel to each other as a result of being guided by the projections 104 through openings 110 and the movement of the cutting projections 100 of the punches into the openings 112 of the dyes.

As best seen in FIG. 5, the handle 24 includes in the rear end thereof a stop plate 132 which is molded integrally with walls 48 and skirt 50 of the handle 24. As best seen in FIGS. 2 and 3, the stop plate 132 is planar and extends transversely between the lateral portions of skirt 50 and from top wall 48 to a lowermost edge 134 which is at the same level as the bottom surface of skirt 50. A small portion of the lowermost edge is straight and then it extends into a cam surface 136 which is at approximately a 45 degree angle with respect to edge 134 and extends towards the horizontally disposed edge 138 which is connected to the cam surface by a vertically disposed edge 137. Another vertically disposed edge 139 is on the other side of edge 138 and extends to an intermediate edge 140 which is a little more than half way between the lowermost edge 134 and the upper edge 138.

A switching device 142 is provided which is mounted in the base 26. The switching device 142, as will hereinafter be seen switches the device 20 into a removal mode when it is desired to remove cassette 30.

The switching device 142 comprises a finger gripping portion 144 and a U-shaped bracket 146. The bracket 146 includes a first leg 148, bridging section 150 and a second leg 152 which acts as a stopping post. The bridging section 150 includes a vertically extending opening 154 which is pivotally connected to a pin 156 which is disposed on the top surface of the bottom wall 70 of base member 26. The pin 156 is swaged to form an enlarged head 158 which prevents removal of the switch 142.

As best seen in FIG. 5, the rear surface of the finger grip 144 contains a bead 160 which coacts with a recess 162 which is formed in the outer most rear surface of the skirt 68 of the base member 26 and the outer surface of the cover member 28. It is shown in phantom at 163 in FIG. 5. The cover member 28 and the skirt 68 have a recessed edge at the top and bottom surfaces which form a slot 162 which extends horizontally to permit the finger grip 144 to be moved from left to right as seen in FIG. 5. As also seen in FIG. 5, the finger grip 144 is in the leftmost position with the bracket member being shown in full at that position.

As best seen in FIG. 2 the skirt 68 of the case 26 includes a recessed wall 165 in which the finger grip 144 is disposed. The ends of the recessed portion of wall 86 thus forms stops to limit the movement of the finger grip 144 and the rotation of the switching member 142.

It should be noted that the stopping post 152 of the switching device 142 is disposed directly below the intermediate edge 140 of the stop plate 132 of handle 24.

Thus, when the switching means is in the position shown in FIG. 5, the handle 24 can be depressed until the stop plate 140 abuts the top surface of the stopping post 152. This first depressed position is shown in phantom in FIG. 3 and in full in FIG. 6 at the rightmost end thereof.

Thus, the bottom edge 140 of the stop plate 132 limits the movement of the handle 24 into the case 22 to the position shown in FIG. 6 with the punch 100 extending into the dyes 112. It should be noted however, that the centering post 120 remains within the opening of top plate 86 of the cassette and thereby prevents removal of the cassette from the punch and embossing device 20.

It should also be noted that a spring 164 is also provided on the switch which is connected at one end to the bridging section 146 between opening 154 and stopping post 152 and at the other end to a pin 166 which is integral with bottom wall 70 and extends upwardly therefrom.

When the finger grip portion 144 is moved from the position shown in FIG. 5 to the position for finger grip 144' shown in FIG. 5 in phantom, the post 152 is aligned with the cam surface 136 and the bead 160 resides in recess 162. Thus, the handle 24 may be moved to the position shown in FIG. 7 with the handle being moved into case 22 as shown in the far right of FIG. 7. As the handle moves into the position shown in FIG. 7, the post 152 thus rides up edge 136 and into the slot between edges 137 and 138 which surround the edge 138 of the stopping plate 132.

This action causes the actuating ends 130 of the handle member 54 to move the top plate 86 of the cassette 30 to the position shown in FIG. 7 with the centering post 120 clearing the top surface of the plate 86. The cassette may then be pulled out by the user by sliding the cassette out of the case.

The action also causes the switch to be rotated about pin 156 and causes the bead 160 to be dislodged from recess 162. This last action prevents the removal of the cassette the next time that the cassette is used to punch an opening unless the switch is reset to the removal mode.

In order to remove the cassette from the case the cassette is moved to the left as shown in FIGS. 3, 6 and 7.

Without further elaboration, the foregoing will so fully illustrate my invention that others may, by applying current or future knowledge, readily adapt the same for use under various conditions of service.

What is claimed is:

1. A punch device for punching out a plurality of designs in a sheet, said punch including a base, a multiple punch cassette and a handle, said handle having a free end and being pivotally connected to said base, said base having a punch station disposed adjacent said handle, said base punch station comprising a platform parallel to the plane in which the axis of pivot of said handle is disposed to support said cassette, said handle containing a member which contacts said cassette when said free end of said handle is pivoted toward said base, said cassette comprising a first plate containing a plurality of punches and a second plate each containing a plurality of dyes each of which is aligned with one of said punches and having a complementary opening to the shape of said punch shape, said first plate normally being spaced from and spring urged away from said second plate so that a sheet may be placed between said plates, said handle member being urged against said first plate when said free end of said handle is pivoted towards said base to cause said first plate to be urged against said second plate, said member contacting said top plate adjacent the center of said plate so that said first plate remains aligned with and substantially parallel to said second plate throughout movement of said first plate with respect to said second plate.

2. The invention of claim 1 wherein said platform is disposed in a slotted opening in said base, said slotted opening receiving said cassette so that said cassette is disposed with said center of said top plate disposed adjacent said handle member with a predetermined one of said punches disposed externally of said base to enable use of said last named punch for punching an opening in said sheet, said sheet being disposed in said space between said punch and said associated respective dye.

3. The invention of claim 1 wherein said handle member is elongated and is integral with said handle at one end, the other end of said member being disposed adjacent the center of the top surface of said cassette so that when said handle is pivoted towards said base said member is urged against said top plate of said cassette to urge said top and bottom plate together, said plurality of punches extending into said dyes so that a sheet disposed in the space between any one of said punches and its respective dye will have an opening punched therein containing the shape of the punch.

4. A punch device for punching out a plurality of designs in a sheet, said punch including a base, a multiple punch cassette and a handle, said handle having a free end and being pivotally connected to said base, said base having a punch station disposed adjacent said handle, said base punch station comprising a platform parallel to the plane in which the axis of pivot of said handle is disposed to support said cassette, said handle containing a member which contacts said cassette when said free end of said handle is pivoted toward said base, said cassette containing a plurality of punches and a plurality of dyes each of which is aligned with and having a complementary opening to the shape of said punch shape, said cassette being placed upon said platform by sliding said cassette into place with a selected punch being disposed for receipt of said sheet, said punch being spaced from and spring urged away from said associated dye so that a sheet may be placed between said plates for punching an opening having the shape of said punch, said handle member being urged against said cassette when said free end of said handle is pivoted towards said base to cause said punch to be urged against said dye and causing an opening to be formed in said sheet having the shape of said last named punch.

5. The device of claim 4 wherein said device includes means for rotatably engaging said cassette, said cassette being rotatable to enable each of said punches to be disposed in the operative position for punching an opening in a sheet.

6. The device of claim 4 wherein said device includes indexing means to enable the cassette to be releasably stationed in a number of fixed positions equal in number to the number of punches in said cassette.

7. An embossing device for punching out a plurality of designs in a sheet, said device including a base, a multiple embossing cassette and a handle, said handle having a free end and being pivotally connected to said base, said base having a punch station disposed adjacent said handle, said base punch station comprising a platform parallel to the plane in which the axis of pivot of said handle is disposed to support said cassette, said handle containing a member which contacts said cassette when said free end of said handle is pivoted toward said base, said cassette comprising a first plate containing a plurality of embossing punches of different design and a second plate each containing a plurality of dyes each of which is aligned with one of said punches and which is complementary to said embossing punch design, said first plate normally being spaced from and spring urged away from said second plate so that a sheet may be placed between said plates, said handle member being urged against said first plate when said free end of said handle is pivoted towards said base to cause said first plate to be urged against said second plate, said member contacting said top plate adjacent the center of said plate so that said first plate remains aligned with and substantially parallel to said second plate throughout movement of said first plate with respect to said second plate.

8. The invention of claim 7 wherein said platform is disposed in a slotted opening in said base, said slotted opening receiving said cassette so that said cassette is disposed with said center of said top plate disposed adjacent said handle member with a predetermined one of said punches disposed externally of said base to enable use of said last named punch for embossing a design in said sheet, said sheet being disposed in said space between said punch and said associated respective dye.

9. The invention of claim 8 wherein said handle member is elongated and is integral with said handle at one end, the other end of said member being disposed adjacent the center of the top surface of said cassette so that when said handle is pivoted towards said base said member is urged against said top plate of said cassette to urge said top and bottom plate together, said plurality of punches extending into said dyes so that a sheet disposed in the space between any one of said punches and its respective dye will have a design impressed therein containing the design of the embossing punch.

10. An embossing device for impressing a plurality of designs in a sheet, said device including a base, a multiple embossing punch cassette and a handle, said handle having a free end and being pivotally connected to said base, said base having a punch station disposed adjacent said handle, said base punch station comprising a platform parallel to the plane in which the axis of pivot of said handle is disposed to support said cassette, said handle containing a member which contacts said cassette when said free end of said handle is pivoted toward said base, said cassette containing a plurality of punches and a plurality of dyes each of which is aligned with and having a complementary opening to the shape of said punch shape, said cassette being placed upon said platform by sliding said cassette into place with a selected punch being disposed for receipt of said sheet, said punch being spaced from and spring urged away from said associated dye so that a sheet may be placed between said plates for impressing a design having the design of said punch, said handle member being urged against said cassette when said free end of said handle is pivoted towards said base to cause said punch to be urged against said dye and causing a design to be impressed in said sheet having the design of said last named punch.

11. The device of claim 4 wherein said device includes means for rotatably engaging said cassette, said cassette being rotatable to enable each of said punches to be disposed in the operative position for punching an opening in a sheet.

12. The device of claim 4 wherein said device includes indexing means to enable the cassette to be releasably stationed in a number of fixed positions equal in number to the number of punches in said cassette.

13. A punching device for punching a plurality of designs in a sheet, said punch including a base, a multiple punch holder and a handle, said handle having a free end and being disposed above said base, said base having a punch station disposed below said handle, said base punch station comprising a platform parallel to the plane in which the holder of said punches is disposed to support said holder, said handle containing a member which contacts said cassette when said handle is pressed toward said base, said holder comprising a first plate containing a plurality of punches and a second plate each containing a plurality of dyes each of which is aligned with one of said punches and being complementary to the design of said punch, said first plate normally being spaced from and spring urged away from said second plate so that a sheet may be placed between said plates, said handle member being urged against said first plate when said handle is urged towards said base to cause said first plate to be urged against said second plate, said member contacting said top plate adjacent the center of said plate so that said first plate remains aligned with and substantially parallel to said second plate throughout movement of said first plate with respect to said second plate.

14. The invention of claim 13 wherein said holder contains embossing punches and hole punches.

15. The invention of claim 13 wherein said holder contains hole punches.

16. The invention of claim 13 wherein said holder contains embossing punches.

* * * * *